US005393003A

United States Patent [19]

Watermann

[11] Patent Number: 5,393,003

[45] Date of Patent: Feb. 28, 1995

[54] APPARATUS FOR THE AUTOMATIC HANDLING OF BOBBIN TUBES AND COMPLETELY WOUND BOBBINS OF SPINNING MACHINES

[76] Inventor: J. Juergen Watermann, Hohenzollerstrasse 17, 4700 Hamm 1, Germany

[21] Appl. No.: 180,754

[22] Filed: Jan. 10, 1994

Related U.S. Application Data

[63] Continuation of Ser. No. 859,391, May 22, 1992, abandoned.

[30] Foreign Application Priority Data

Oct. 2, 1990 [DE] Germany ..... 4031076

[51] Int. Cl.[6] ..... B65H 67/04

[52] U.S. Cl. ..... 242/35.5 A

[58] Field of Search ..... 242/35.5 A, 35.5 R, 242/18 A, 18 R

[56] References Cited

U.S. PATENT DOCUMENTS

| | | | |
|---|---|---|---|
| 4,007,882 | 2/1977 | Isoard | 242/35.5 A X |
| 4,023,743 | 5/1977 | Schippers | 242/35.5 A |
| 4,340,187 | 7/1982 | Schippers et al. | 242/35.5 A |
| 4,427,158 | 1/1984 | Conrad | 242/35.5 A |
| 4,441,660 | 4/1984 | Conrad et al. | 242/35.5 A |
| 4,615,493 | 10/1986 | Teranishi et al. | 242/35.5 A |
| 4,621,778 | 11/1986 | Paravella et al. | 242/35.5 A |

FOREIGN PATENT DOCUMENTS

| | | |
|---|---|---|
| 0026471 | 4/1981 | European Pat. Off. . |
| 0096971 | 12/1983 | European Pat. Off. . |
| 0110275 | 6/1984 | European Pat. Off. . |
| 0311016 | 4/1989 | European Pat. Off. . |

*Primary Examiner*—Stanley N. Gilreath
*Attorney, Agent, or Firm*—Anderson Kill Olick & Oshinsky

[57] ABSTRACT

A device for the at least partially automatic handling of empty bobbin cases and fully wound bobbins in spinning machines is designed to provide a system by which the manipulation of both finished bobbins and also empty cases is simplified, while a special aim of the invention is to automate the removal and insertion processes as completely as possible. This is achieved in that on a shared fixture frame (12) there is a reception/transfer arm (8) for empty cases (5), a reception/transfer arm (6) for bobbins (4) and an actuating and pivoting mechanism (16–18) to take arms (6,8) from a stopped to a transport position.

11 Claims, 9 Drawing Sheets

FIG.13
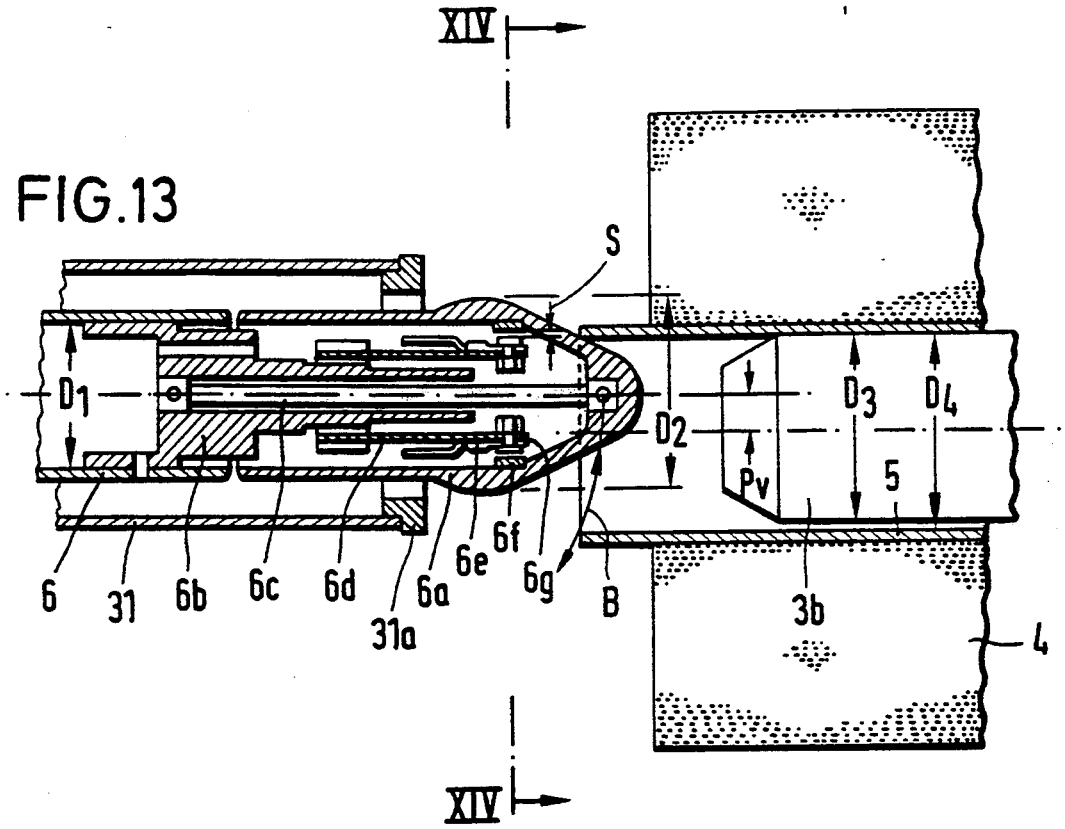
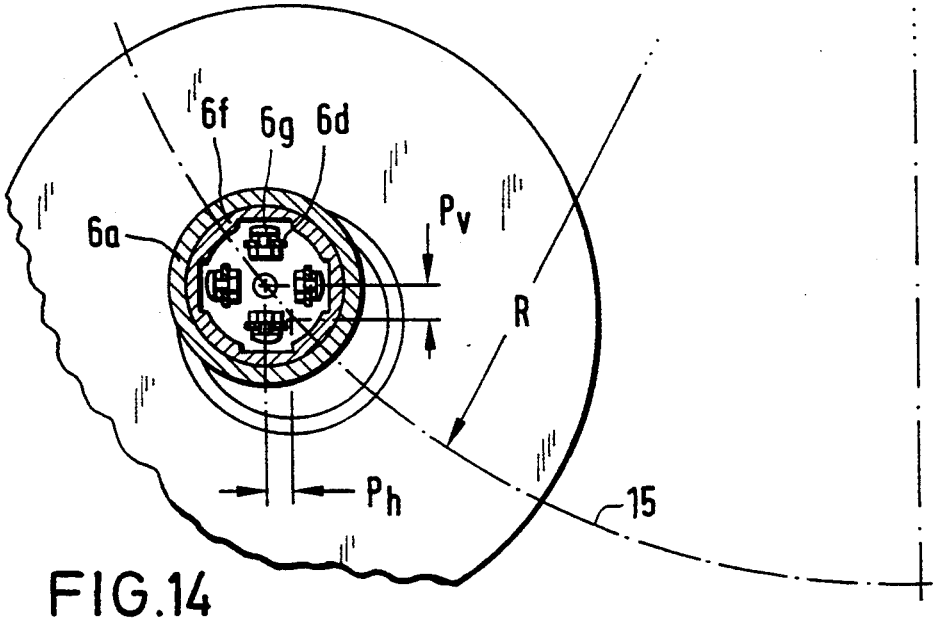
FIG.14

APPARATUS FOR THE AUTOMATIC HANDLING OF BOBBIN TUBES AND COMPLETELY WOUND BOBBINS OF SPINNING MACHINES

This is a continuation of application Ser. No. 07/859,391, filed May 22, 1992, now abandoned.

The invention is directed to an apparatus for at least partially automatic handling of bobbin tubes and completely wound bobbins of spinning machines.

There are many fibers, threads and the like which are wound by spinning machines to form bobbins, either supply bobbins for intermediate storage or complete bobbins for further processing and the like. In general, the winding of plastic fibers to form bobbins is of primary concern in the present case. Of course, the present invention can also be used for manipulating textiles bobbins of non-synthetic origin, for wire coils or for bobbins of threads or cords of hemp or the like.

These bobbins are sometimes so heavy that their handling by personnel requires great effort, i.e. removing completely wound bobbin bodies from the winders or from the bobbin heads can be very burdensome. In addition, the exposed winding spindle must be re-outfitted with empty tubes of paper or plastic as quickly as possible after this. These paper tubes must be taken from a storage location and placed on the winding spindles. The completely wound bobbins which are removed must be deposited in another location for further transportation.

The object of the invention is to provide a solution for simplifying the handling of complete bobbins as well as empty tubes, wherein a particular aim of the invention consists in automating the removal and placement processes in the most comprehensive manner possible.

This object is met, according to the invention, with an apparatus of the type described in the beginning in such a way that a take-over/transfer arm for empty tubes, a take-over/transfer arm for bobbins, and an actuating and swivel mechanism for moving the arms from a work position into a transporting position are provided on a common or combination apparatus frame.

As a result of the invention, outfitting with empty tubes, removal of bobbins and transporting of either empty tubes or bobbins can be carried out by a single apparatus, since the take-over and transfer arms can work automatically for the empty tubes or the bobbins after the apparatus is positioned.

In a further construction of the invention the take-over/transfer arms are supported so as to be swivelable around at least one common axis of rotation via the swivel mechanism. It can be provided in another construction that the take-over/transfer arms are supported inside the apparatus frame so as to be swivelable around all three spatial axes.

The advantage of this construction consists particularly in that the apparatus can be designed as a very compact device, since the ability of the arms to swivel around the same spatial axis enables a compact construction.

It is advantageous if the actuating swivel mechanism is constructed for a synchronous driving of the arms at least by areas, as is likewise provided by the invention. An asynchronous swiveling is also possible, although this is effected around the same spatial axis.

The invention also provides that the take-over/transfer arms are outfitted at their free ends with positioning heads to compensate for slight positioning inaccuracies. In addition to the above-mentioned steps according to the invention, it can also be provided for the compensation of positioning inaccuracies that the actuating and swivel mechanism and accordingly also the take-over/-transfer arms are supported at the apparatus frame by means of a torque rod suspension.

It can also be provided in a construction according to the invention that the torque rod suspension itself is supported at the apparatus frame by means of a swivel mechanism. This swivel mechanism can also be used to swivel the work position in the horizontal plane of the take-over/transfer arms by at least 90°.

The invention also provides that the take-over/transfer arms are outfitted in each instance with a device for slipping off and slipping on the tubes or bobbins to enable a substantially fully automated operation.

In a preferred construction of the invention it is also provided that the apparatus frame can be outfitted with an undercarriage. In particular, the undercarriage is provided with all-wheel steering.

These constructions make it possible to make use of the entire apparatus as a handling robot in a fully automated manner, possibly via microcomputers, since it can work in a fully automatic manner by means of the positioning device, all-wheel steering and possibly its own drive without the aid of personnel.

Further constructions and advantages of the invention follow from the additional subclaims. It is particularly advantageous if the undercarriage is constructed as a three-wheel undercarriage with single-wheel drive, which can be provided in a modification according to the invention.

The take-over/transfer arms can be advantageously constructed for receiving and delivering a plurality of elements. In this respect, the invention can be effected in such a way that a transfer or take-over or pushing movement is controllable in such a way that the tubes or bobbins can be positioned so as to be closely adjacent to one another and/or at a distance from one another.

All movements of the apparatus, those for the take-over/transfer arms and those for the slip on and slip off movements, can be provided by magnet couplings and-/or magnet brakes for the purpose of positioning the movements at the various positions of the work cycle.

Further, hysteresis couplings can be provided in the drives so that every movement can be defined with respect to force in an adjustable manner. Moreover, this allows each movement to be moved against fixed stops at end points. End switches operating either with or without contact are provided only at the respective starting point (zero reference).

The positioning of the drives can be carried out by digital pulse counters so that when the actual value equals the reference value the movement is positioned at the desired location by means of its magnet coupling and/or magnet brake.

The invention is explained in more detail in the following by way of example with reference to the drawing.

Figure 11:
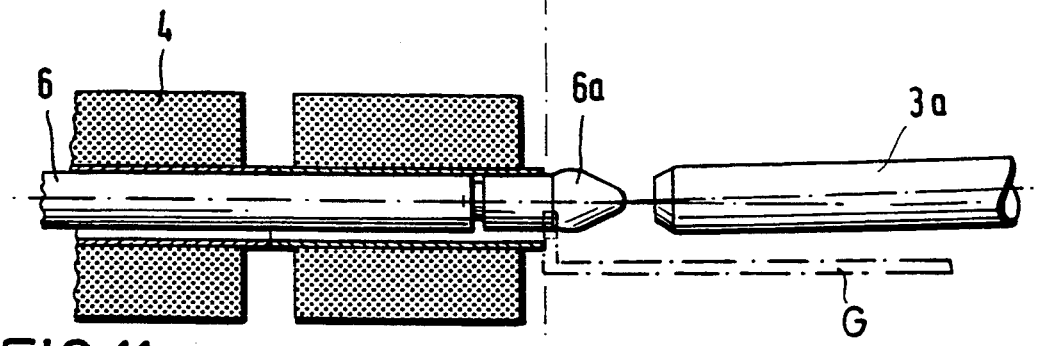
Figure 12:
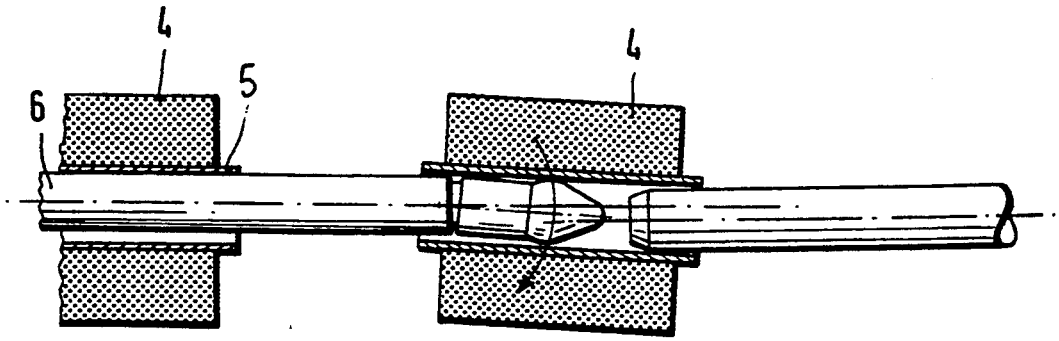

FIG. 11 shows a partial cross-sectional view illustrating further different starting positions of a winding spindle relative to a bobbin spindle and, particularly, relative to the positioning head of the bobbin spindle; and FIG. 12 shows a partial cross-sectional view illustrating how the positioning head stops an automatic operation of an apparatus if the transfer of a bobbin from the winder winding spindle is incomplete or faulty.

FIG. 13 shows a detail in longitudinal section through the positioning head of a bobbin spindle; and FIG. 14 shows a section according to line XIV—XIV in FIG. 13.

Figure 1:
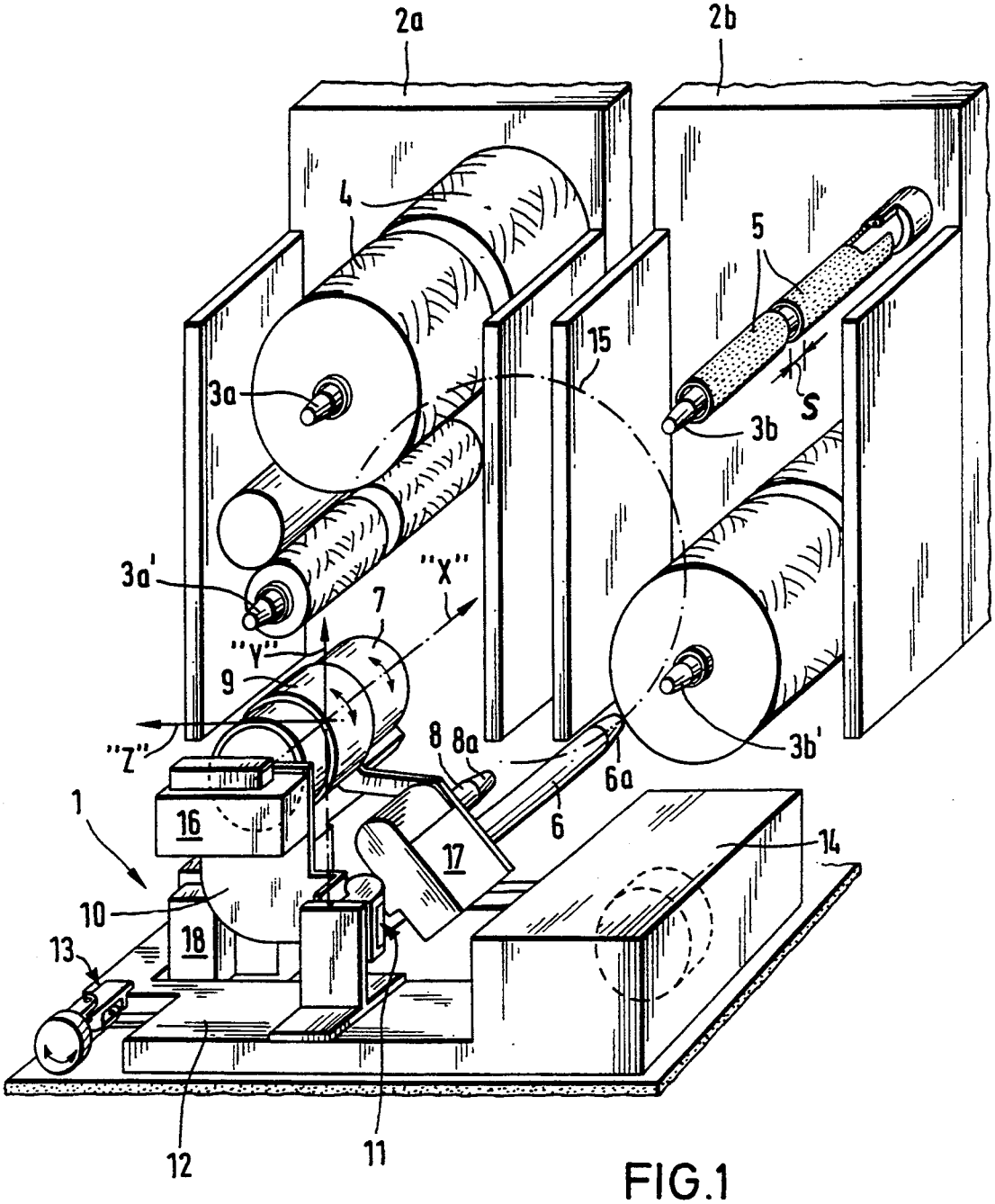
FIG. 1 shows a simplified spatial view of the apparatuses in front of the bobbin heads of a spinning machine.

FIG. 1 is a simplified view of the apparatus according to the invention, designated in general by 1, in front of bobbin heads, designated by 2*a* and 2*b*, of spinning machines, not shown in more detail. The spinning heads 2*a* and 2*b* comprise winding spindles designated by 3*a*, 3*a*′ and 3*b*, 3*b*′. Two bobbins 4 and, correspondingly, two empty tubes 5 are provided on the spindles 3 in the shown example.

The handling apparatus 1 according to the invention comprises a slip on and slip off spindle 6 at a turret head 7, which slip on and slip off spindle 6 is swivelable around a horizontal axis "X", and a slip on and slip off spindle 8 for tubes which is swivelable around the same horizontal axis "X" and is supported so as to be swivelable at a turret head 9. The turret heads 7 and 9 are supported on one axis at the apparatus 1 at a supporting element 10 as can be seen.

The supporting element 10 is fastened in turn at the apparatus frame, designated by 12, by means of a torque rod suspension 11. The apparatus frame 12 is outfitted with an undercarriage, designated generally by 13, which possibly has its own drive which is shown only in a suggestive manner in FIG. 1 and designated by 14.

In the following, the spindle for slipping on and slipping off the bobbins is designated as "bobbin arm 6" and the spindle for the empty tubes is designated as "tube arm 8".

It can be seen from FIG. 1 that the bobbin arm 6 and the tube arm 8 sweep along a circular arc, jointly designated by 15, due to their coaxial arrangement on the spatial axis "X". The circular arc is designed geometrically in such a way that the two winding spindles 3*a* and 3*a*′, respectively, 3*b* and 3*b*′, which are arranged at a distance from one another, can approach one another when positioning in front of a spinning head.

The spatial axis "Y" is drawn in FIG. 1 in the region of the torque rod 11 and the spatial axis "Z" is drawn in the region of the turret head 9. The supporting plate 10 can be swiveled around the spatial axis "Y" in the region of the torque axis 11 as can be seen somewhat more clearly from FIG. 7. The supports of the bobbin arm 6 and tube arm 8 are designed in such a way that the arms can likewise be swiveled, the spatial axis "Z" being given here only as an example. This swiveling possibility can be seen clearly from FIG. 2.

Finally, a drive 16 (indicated only as boxes) for the turret heads 7 and 9 with the tube arms 6 and 8, a rotating swivel drive 17 for the tube arm 6, and a rotating swivel drive 18 at the arm 8 are shown in FIG. 1. Details of these drives can be seen from the other figures, particularly FIG. 3.

Figure 2:
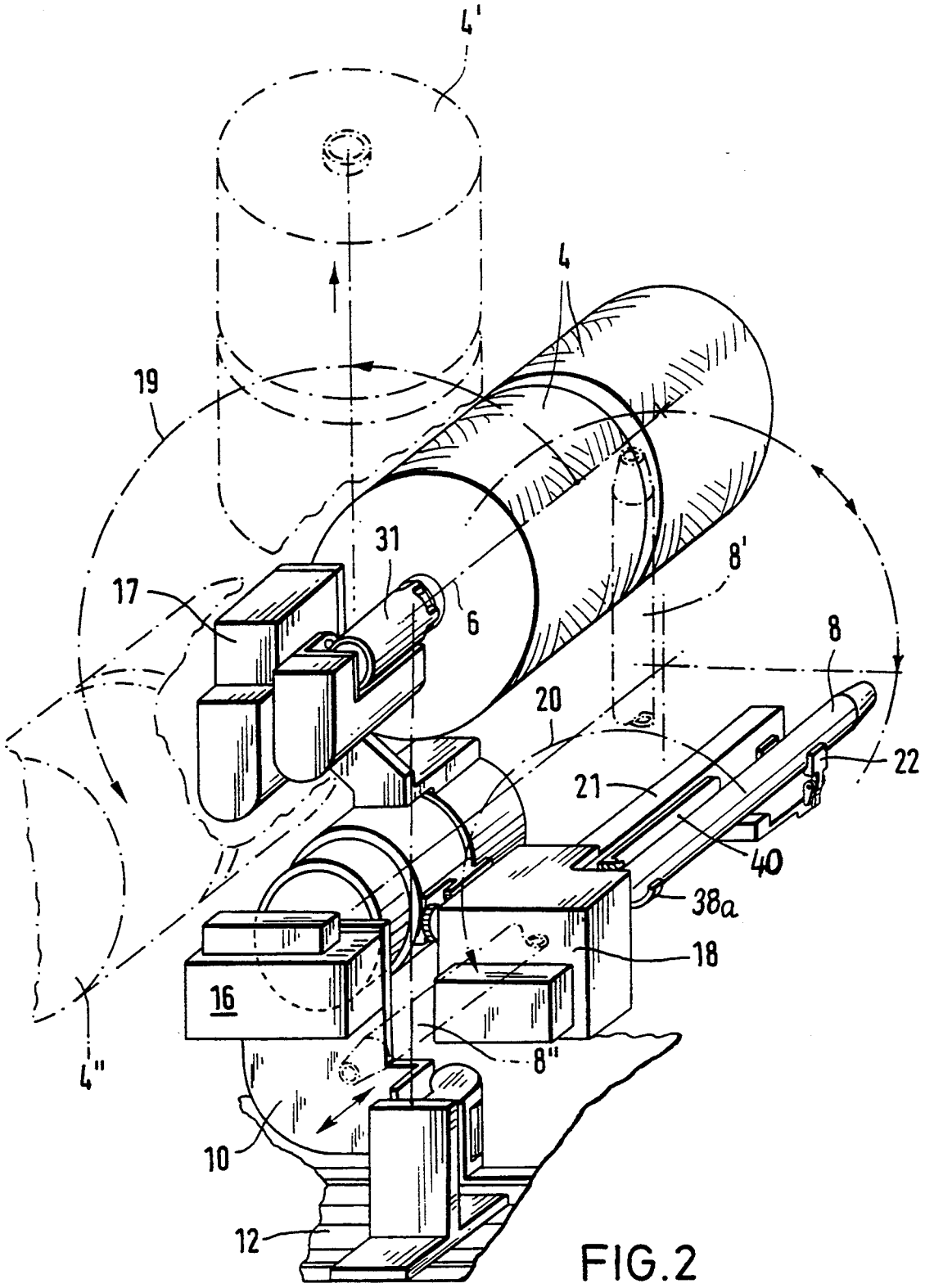
FIG. 2 shows an enlarged view of elements of the apparatus.

It can be seen from FIG. 2 that the bobbin arm 6 has already moved upward from the position shown in FIG. 1, e.g. by 135°, after having taken over two bobbins 4. The bobbin arm 6 can be swiveled up by 90° from this position which is shown in solid lines. This position with a bobbin 4′ and moved by an additional 90° with a bobbin 4″ is indicated in a dotted line. The swivel circle is designated by 19.

As indicated above, the swivel axis is designated substantially by the spatial axis "Z", wherein a swiveling can also be effected in other positions of the spatial axis "Z".

The position "4‴" which faces upward is a transporting position for the bobbins 4. Position "4⁗" can be the slip off position of the complete bobbins into a storage or the like, not shown in more detail.

The tube arm 8 can be swiveled in the same manner. The position facing up by 90° is designated by 8′. The position swiveled by 180°, likewise shown in dashes, is designated by 8″. The swivel circle is designated by 20, wherein the shown position of the tube arm 8 which is likewise swiveled by 90° relative to the position shown in FIG. 1 is shown here.

The operation of the inventive apparatus will now be described in more detail. In FIG. 1, the bobbin heads 2*a* and 2*b* are shown in their respective upper and lower service positions in which the completely wound bobbins 4 are removed from the respective spindles 3*a* and $3b^1$ and empty tubes are placed on the spindles 3*a* and $3b^1$.

FIG. 1 shows that removal of the completely wound bobbins and placing of the empty bobbin tubes thereinstead, can be effected alternatively in upper and lower positions of the spindles of the bobbin head. By way of an example, the removal of a completely wound bobbin and placing an empty tube will be described with reference to the spindle $3b^1$. For servicing the spindle $3b_1$ which is shown in FIG. 1 in its lower service position, the turret head 9, together with the tube arm 8, are rotated along a circular arc 15 about the axis "X" downward and, the turret head 7, together with the bobbin arm 8, are rotated to a position in which the bobbin arm 6 is located opposite the spindle $3b^1$ with a completely wound bobbin thereon.

After the wound bobbins 4 have been slipped into the bobbin arm 6 in a manner, which will be discussed in more detail further below, the turret head 7, together with the bobbin arm 6 carrying the bobbins 4, move upward along the circular arc 15 and the turret head 9, together with the tube arm 8 carrying empty tubes, move to a position in which the tube arm 8 is located opposite the spindle $3b^1$. In this position, the empty tubes are slipped off the tube arm and onto the spindle $3b^1$ in a manner described in detail further below.

Figure 3:
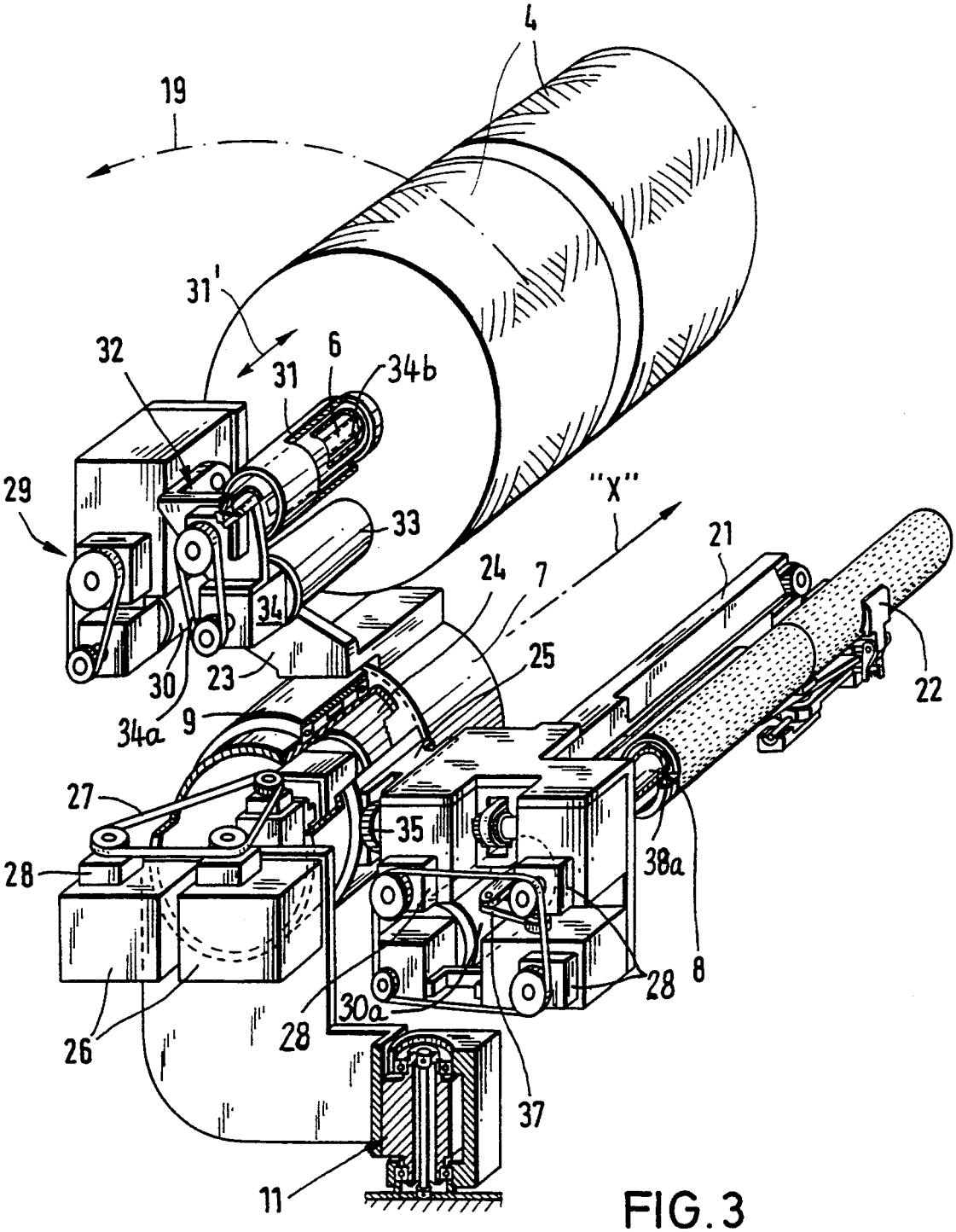
FIG. 3 shows a view similar to FIG. 2 with slightly enlarged additional details of the drives.

After the servicing of the spindle $3b^1$, both turrets 7 and 9, together with their respective arms 6 and 8, move from the servicing position to a position shown in FIGS. 2 and 3. In this position, the bobbin arm 6 and the tube arm 8 are pivoted into a vertical position, which is shown in dashed lines in FIG. 2, and is defined by the axis "Y". With the bobbin arm 6 carrying bobbins 4 and the tube arm 8 without empty tubes, the undercarriage 13 moves to a bobbin unloading and empty tube loading station.

At the bobbin unloading and empty tube loading station, the bobbin arm 6 and the tube arm 8 are pivoted or swiveled by 90° into a position, defined by the axis "Z", in which the bobbins 4 are slipped off the bobbin arm 6 and empty tubes are slipped onto the tube arm 8.

As can be seen from both FIG. 1 and FIG. 2, there is a slip on and slip off apparatus 21 with clamping and thrust arms 22 which is arranged parallel to the tube arm 8 for handling the empty tubes positioned there. A somewhat more detailed view can be seen from FIG. 3.

With respect to the description of the torque rod suspension, designated in general by 11, which is shown in the lower portion of FIG. 3, reference is made to FIG. 7 which will be described in the following.

As can be seen from FIG. 3, the bobbin arm 6 is rotatably supported along the swivel axis "X" by a holder 23 at the rotating or turret head 7. The rotary drive of the turret head 7 is effected via an internal electric motor 24.

The rotational movement around the spatial axis "X" of the tube arm 8 is effected in a similar manner, the tube arm 8 being fastened at the turret head 9 via a supporting element 25.

The control, and accordingly the synchronous or asynchronous rotational movement around the axis "X" of the arms 6 and 8, respectively, is effected by worm gear units 26 and a V-belt drive 27, shown here only in a suggestive manner, as well as by the assigned electromagnetic couplings and brakes which are designated only by way of example at one location by 28.

The module 28 with an electromagnetic coupling and brake assembly permits to select either a simultaneous motion or a separate motion of the turret head, as required by the operational cycle, to service a winder.

The swiveling movements according to radius 19 of the bobbin arm 6 are effected by a drive, designated in general by 29, comprising an electric motor 30, gear units, brakes and the like, while the linear movement of a slip off sleeve 31 is effected according to the double arrow 31' of the bobbins 4 via a drive which is designated in general by 32 and likewise comprises an electric motor 33, a hysteresis coupling 34 with toothed belt drive, and the like.

The slip-off sleeve 31, which has a length L engages, with its front end the tube 5 of a bobbin 4 in order to displace the bobbins 4 from the bobbin arm 6, at station 54 (FIG. 8), onto receiving rods of a conveyor system to transport the finished bobbins out of the spinning area for further handling. The slip-off sleeve 31 is attached by a connecting bar 31*a*, to a nut of a lead screw 34*b*. A motor 33 drives the lead screw 34*b* via a gearbox 34 and a toothbelt drive 34A. The rotation of the lead screw 34*b* results in a linear displacement of the nut and the slip-off sleeve 31 which is connected therewith. After the slip-off sleeve displaces finished bobbins 4 from the arm 6, it places the bobbins from the winding spindle, e.g., 3*a* onto the bobbin arm 6.

Figure 4:
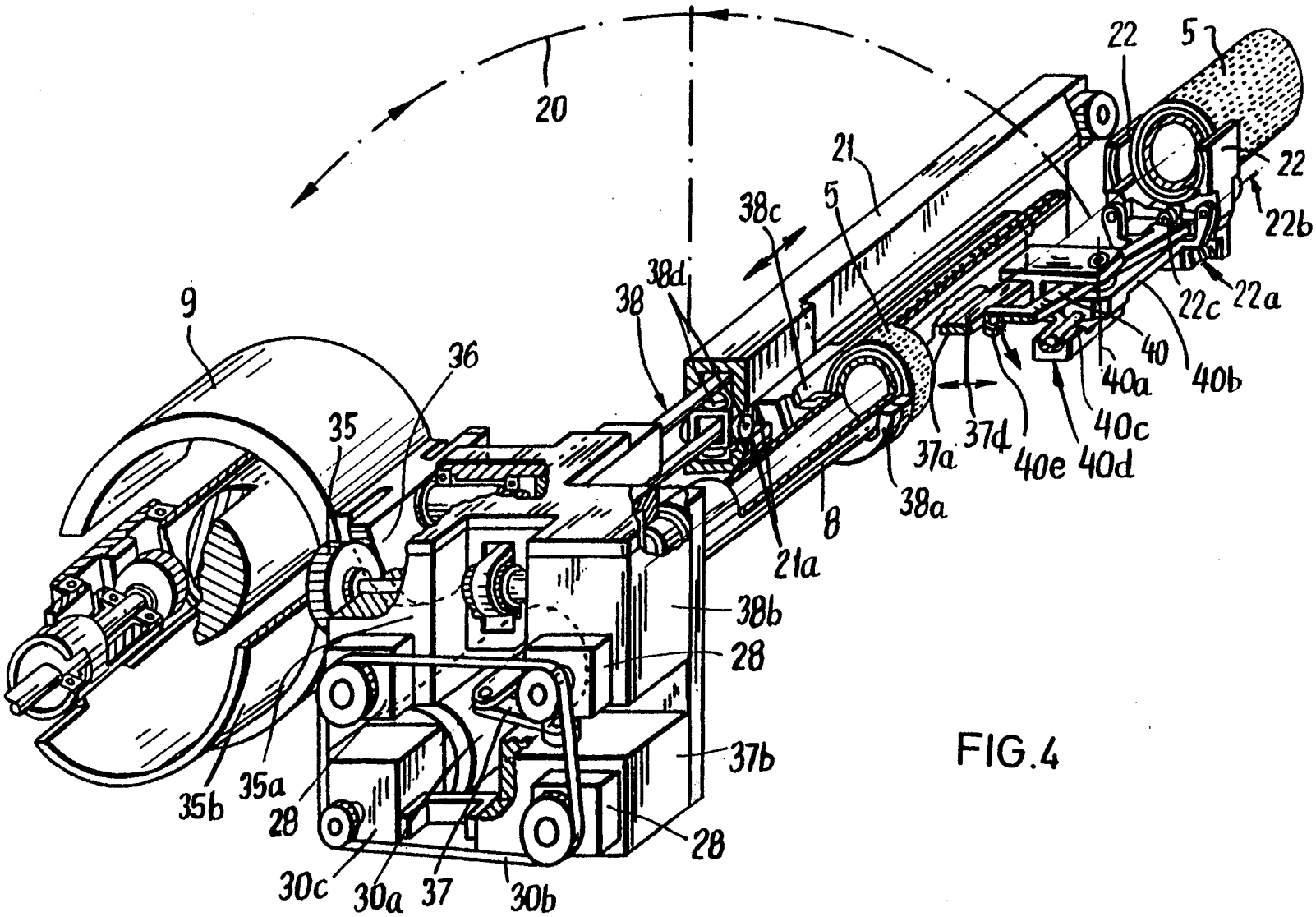
FIG. 4 shows a partial view of a tube or slip on arm.

The swiveling movement of the tube arm according to radius 20 (FIG. 2) is effected by the rotation of a toothed wheel 35 meshing with a fastening toothed rim 36 which is fixed at the turret head 9 (FIG. 4).

The clamping control of the clamping jaws 22 is effected via a lever drive 40, again by means of corresponding motors and couplings, as well as a four-bar linkage 37. With reference to FIG. 4, the pull on and push out movement can be effected e.g. via a toothed belt drive designated generally by 38 in FIG. 4.

Figure 5:
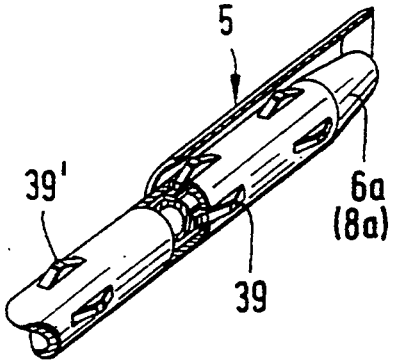
FIG. 5 shows another partial view of a take-over/-transfer arm.

FIG. 5 shows a possible, soft spring-mounted centering of the tubes for centering the latter relative to the substantially smaller tube spindle 8. These centering cams 39 are pressed radially outward by a spring arranged in the interior of the tube spindle 8 until the cam projections 39' contact the inner diameter of the tube 5 and accordingly ensure a slight play between the tubes and centering cams.

When slipping the tubes on the winder spindle by means of the linear unit 21 the soft tube centering means permits considerable relative movements of the tubes for preventing alignment errors relative to the winder spindle.

The apparatus 21 includes tracks 21*a* and a tooth-belt drive 38 for effecting a linear motion of a fork 38*a* and the clamp jaws 22, which both are attached to a guide bracket 38*c* movable on rollers 38*d* in the linear track 21*a*. The tooth belt is driven by a motor 30*a*, tooth-belt 30*b*, gear box 38*b* and a module 28 containing appropriate electromagnetic coupling and brakes. The electromagnetic couplings and brakes provide for axial motion of a fork 38*a* and clamp jaws 22, which have a common support bracket 40 with the fork 38*a* (as shown in FIG. 2). The support bracket 40 is moved axially by a tooth belt 38. The axial motion of the fork 38*a* and the paws 22 provides for placing the tubes 5, onto the winding spindle, for example, with clamp jaws 22 being open. The electromagnetic couplings and brakes also provide for swivel actuation of a lever 40, which opens the spring-closing clamp jaws 22. The module 28 is provided for each gear box 35*a*, 37*b*, and 38*b* which effect the foregoing motions.

The fork 38*a* moves forward, with clamp-jaws 22 opened by the four-bar linkage 37, to push the tube 5 from tube-arm 8 onto the winder's winding-spindle 3*b*, for example, from which the finished bobbins 4 have just been dispensed onto the bobbin-arm 6.

Tubes 5 are pushed end to end against a collar on the winder's winding spindle by the fork 38*a* with an adjustable force as provided by torque setting of the hysteresis-clutch 30*c* at the drive-motor 30*a*.

This is the O reference position for tube 5 positioned on the winder's winding spindle.

From this position, the fork 38*a* moves backward, with the clamp-jaws 22 still opened by the four-bar linkage 37, until clamp-jaws 22 face the front tube 5.

The linear motion of the fork 38*a* and the jaws 22 stop, and the four-bar linkage 37 is retracted by means of gearbox 37*b* allowing thereby the clamp-jaws 22 to close by means of spring 22*a* in order to grip the front tube 5.

The backward linear motion of the fork 38*a* and the jaws 22 continues in creep-speed until the required spacing S between front and rear-tubes is obtained (see FIG. 1).

The backward linear motion of the fork 38*a* and the jaws 22 is stopped, when spacing S is reached. The clamp-jaws 22 are opened by means of the four-bar linkage 37 against the force of the spring 22*a*.

The backward linear motion of the fork 38*a* and the opened clamp-jaws 22 continues at a normal speed to the retracted end-position, which signals completion of positioning of tubes 5.

The guide-bracket 38*c* has a pivot-center 40*a* around which an opening lever 40 swivels to open the clamp-jaws 22 against the force of the closing-spring 22*a*.

The lever 40 with its tapered plane at the front end lifts one of the rollers 22*c* attached to both jaws 22, which causes them to swivel around the pivot 22*b*, thus opening the jaws 22 against the force of the spring 22*a*.

The opening-lever 40 opens the jaws 22 by motion of a lever 37*a* of the four-bar linkage 37.

The four-bar linkage 37 is intended to allow the opening and closing of the jaws 22 at each point of the linear motion of the guide-bracket 38*c* by causing a roller 40*a* on the lever 40 to move around the pivot 40*a*.

The support-bracket 40*b* for the finger-pivots 22*b* and the closing spring 22*a* is supported on the pivot 40*a* and centered by a soft-mount consisting of a pin 40*c* and a soft-rubber bushing 40*d*.

Figure 6:
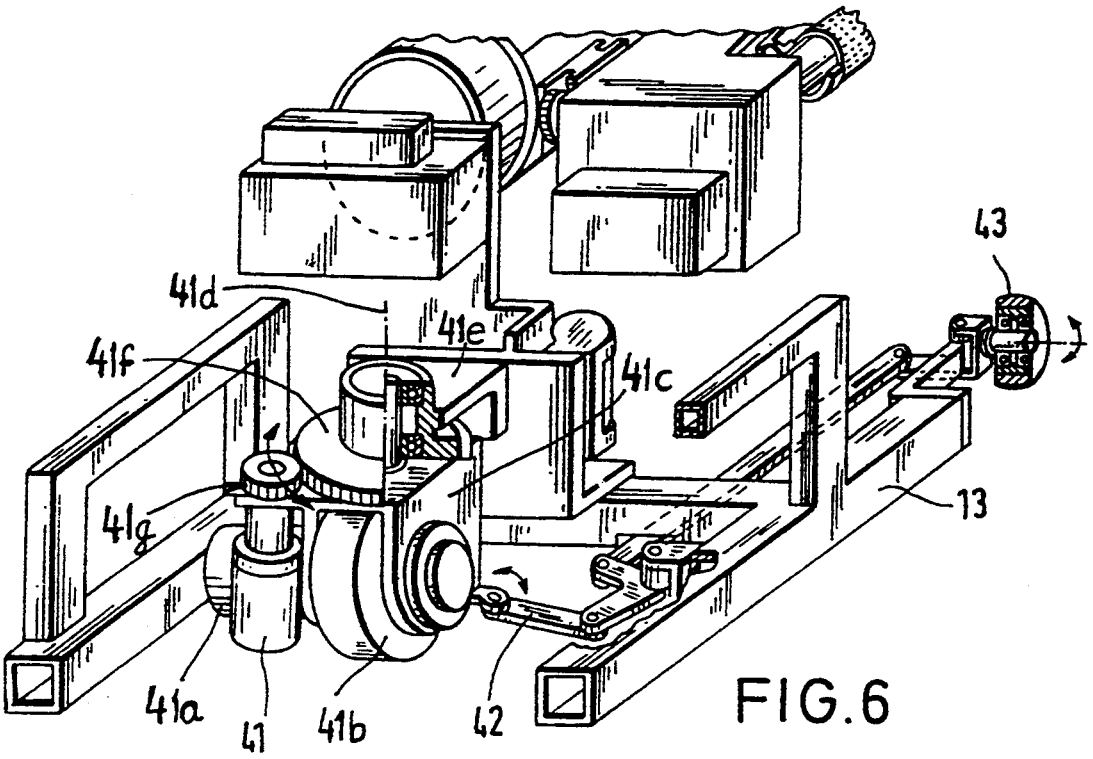
FIG. 6 shows a partial view of an undercarriage of the apparatus.

FIG. 6 shows a possible type of all-wheel steering of the undercarriage 13. The drive motor itself is not shown, but only the steering motor, designated by 41. The all-wheel sheering includes travel-drive motor 41*a* which powers a drive wheel 41*b* for forward/backward motion.

The drive-motor 41*a* and the drive wheel 41*b* are mounted on a rotational steering bracket 41*c* which rotates around an axis 41*d* on bearings in support 41*e* with a stationary gear 41*f*.

The steering motor 41 with its drive-gear 41*g* is mounted on the rotational steering-bracket 41*c* as well, which causes steering of the drive-wheel 41*b* and rotation of the bracket 41*c* around the central axis 41*d*, whereby the steering-motor 41 and its drive-gear 41*g* meshing with the stationary gear 41*f*, move in a planetary fashion around the gear 41*f* and the axis 41*d*.

Attached to the rotating steering-bracket 41*c* is one set each, at the right and left hand side of the undercarriage 13, of pivoted steering-levers 42 to cause a rotary steering motion of the rear rollers 43, one each arranged at the left and right hand side of the undercarriage 13. Naturally, the swivel lever system can be omitted depending on the construction and manner of use.

Figure 7:
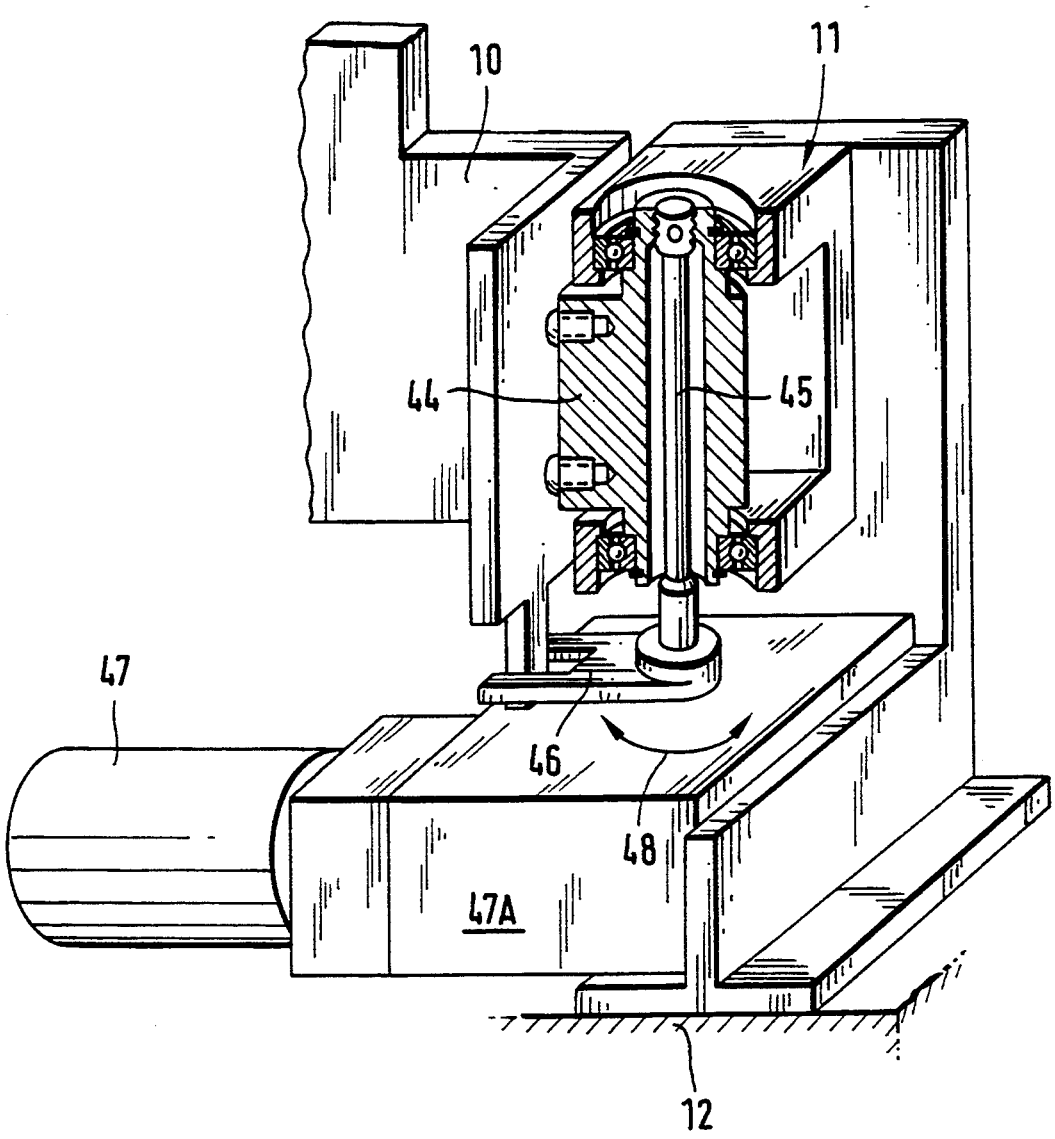
FIG. 7 shows an enlarged view of the torque rod suspension of the take-over/transfer arms.

FIG. 7 shows the suspension via a torque rod system. This torque rod suspension 11 substantially comprises a torque rod 45 which is securely supported at the top in a bearing bush 44 and is held below in the worm wheel of the gear unit 47A, its position being adjustable relative to the stationary supporting frame 10, shown here only in a suggestive manner, via an adjusting motor 47 according to the double arrow 48. On the one hand, this arrangement permits the entire apparatus 1 with the supporting frame 10 fastened at the bearing bush 44 to be swiveled horizontally by means of the adjusting motor 47 in the event that the bobbin store for slipping off the bobbin and the tube magazine require this orientation.

The fork 46 grasps the protuberance of the supporting frame 10 with a play of e.g. approximately 2 mm and serves only as an accessory swiveling means so as not to overburden the torque rod 45. On the other hand, the arrangement makes it possible for the torque rod 45 to compensate for inaccuracies in the aligning positions of the take-over/transfer of bobbins and tubes in every horizontal position of the swiveling 48.

Figure 8:
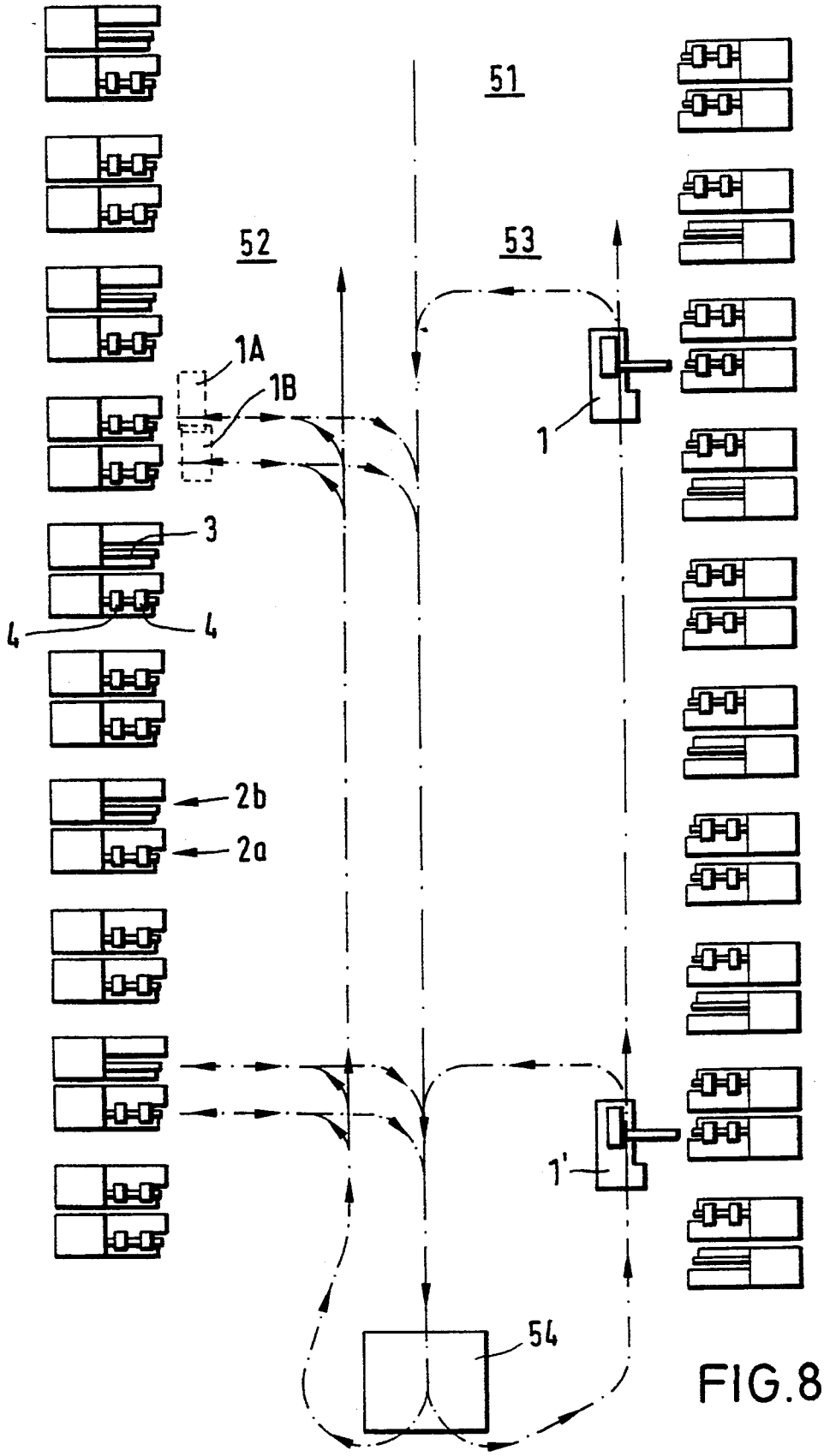
FIG. 8 shows a top view of the movement path of an apparatus according to the invention, which can be controlled in a fully automatic manner, in the region of the bobbin heads of a plurality of spinning machines.

The manner of functioning and operation of the apparatus is explained in the following with reference to FIG. 1 in combination with FIG. 8:

Two rows of spinning machines with bobbin heads 2*a* and 2*b* facing an aisle designated by 52 and 53, respectively, are set up in a workshop hall which is designated in general by 51 and shown in FIG. 8 only in a suggestive manner. The winding spindles 3 of the bobbin heads 2*a* and 2*b* are aligned in the direction of the aisles 52 and 53. The apparatus 1 according to the invention is used for removing the bobbins 4 which are completely wound on the winding spindles and is capable of automatically moving toward every position of a spinning machine in the area of the winding heads 2*a* and 2*b* so as to be controlled e.g. via floor contact lines. It is assumed that an apparatus 1 outfitted with empty tubes moves through the aisle 52 into position 1*a*, shown in FIG. 8, proceeding from a transfer station designated by 54. The apparatus 1*a* is positioned in such a way that the winding spindles 3*b* and 3*b*′ can be sweeped along the swivel radius 15 (FIG. 1). For exact positioning and alignment relative to the winding spindles 3, both the bobbin arm 6 and the tube arm 8 comprise corresponding positioning heads 6*a* and 8*a*, respectively, which enable an accurate alignment. A slight twisting is likewise enabled by the torque rod suspension 11. The latter reinforces the positioning in the event of slightly incorrect positions.

Moreover, a repositioning of the apparatus 1 can be effected electronically, e.g. by measurement of force or twisting. This repositioning can be effected in that the drive moves the apparatus 1 a short distance on the floor of the workshop hall, i.e. the supporting frame 10 is guided in a corresponding manner via the swivel fork 46 (FIG. 7), i.e. by means of the adjusting motor 47.

When the apparatus 1 is in position, the bobbin arm 6 swivels on a winding spindle which is filled with one or more bobbins 4. The completed bobbins 4 are now slipped on the bobbin spindle 6 via a linear drive belonging to the winder, as shown in FIG. 1 with winder 2*b*, by means of a fork G.

When the bobbins 4 are slipped on, the bobbin arm 6 can first be moved into the swiveled up position designated by 4′ in FIG. 2. The tube arm 8 is then swiveled into the corresponding aligning position relative to the winder spindle which has just been emptied and the empty tubes 5 are slipped onto the empty winder spindle via the push out mechanism.

The tube spindle 8 can now also be swiveled up and the bobbins 4 can be moved with the apparatus 1 for delivering to the station 54, as can likewise be seen from FIG. 8.

Different starting positions between a bobbin spindle 6 and a winding spindle 3 are shown in FIGS. 9 to 12, particularly with respect to the positioning head 6*a* of the bobbin spindle 6.

A construction of the positioning head 6*a* is shown in more detail in FIGS. 13 and 14.

Figure 9:
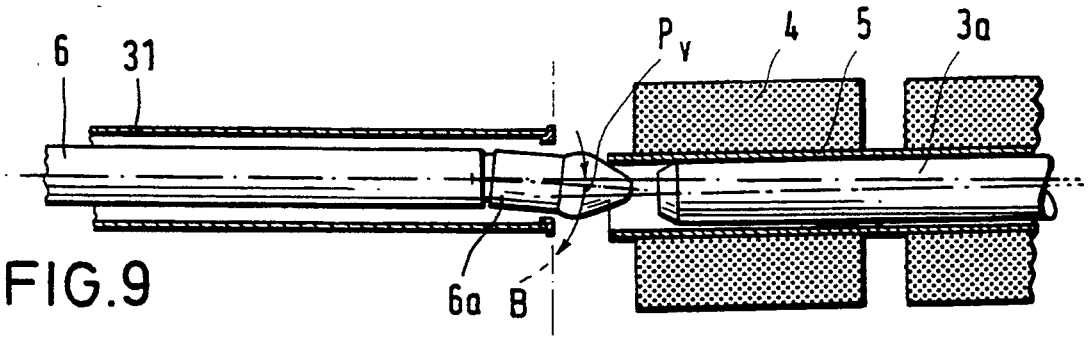
FIG. 9 shows a partial cross-sectional view illustrating one of different starting positions of a winding spindle relative to a bobbin spindle and, particularly, relative to the positioning head of the bobbin spindle.

The alignment of the apparatus 1 relative to the winding spindles 3, 3*b*, and 3*b*′, respectively, which was already discussed in the preceding can be carried out as shown in FIGS. 9 to 12. The tube 5 of the front bobbin 4 strikes against the conical positioning head 6*a* at the bobbin spindle 6 as shown in FIG. 9. The positioning head 6*a* is fastened in the interior of the bobbin spindle 6 by means of a bending rod and bends slightly in the direction B of an alignment error Pv and accordingly closes an electrical contact 6g in the interior of the positioning head 6a, so that a repositioning of the apparatus 1 for error Pv is initiated.

Figure 10:
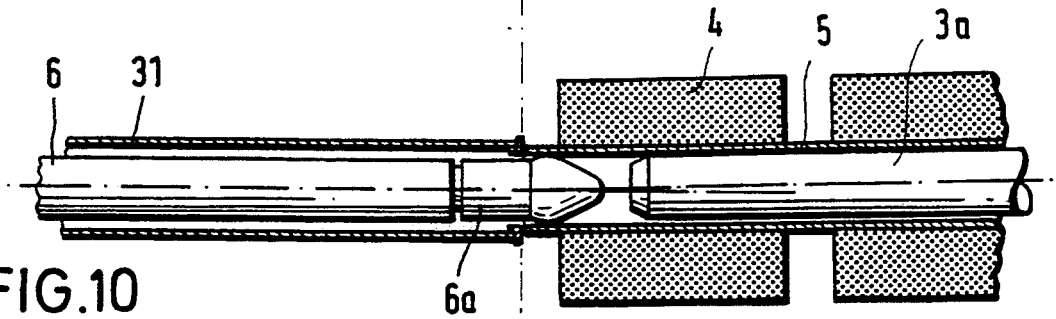
FIG. 10 shows a partial cross-sectional view illustrating another of different starting positions of a winding spindle relative to a bobbin spindle and, particularly, relative to the positioning head of the bobbin spindle.

This readjustment is terminated when the front edge of the tube 5 contacts the end face of the slip off sleeve 31 and the positioning head 6a has arrived centrically in the bore hole of tube 5 and opens the electrical contact 6g, since there is no longer any bending of the positioning head 6a, as shown in FIG. 10.

This causes the slip off sleeve 31 to move back and the completed bobbin to be slipped on the bobbin spindle 6 by means of the fork G, wherein all four electrical contacts 6g (see FIG. 14) in the positioning head 6a are deactivated in order to prevent error signals due to relative movements of the bobbin (FIG. 11).

The four electrical contacts are provided in the positioning head for:

position error vertical $\pm P_v$, which can be compensated for e.g. by forward/reverse running of the turret head drive motor 24 position error horizontal $\pm P_h$, which can be compensated for e.g. by means of forward/reverse running of the travel drive motor 41a.

This readjustment of the apparatus in both planes can be carried out either individually or synchronously, since the slight bending of the positioning head 6a caused by the position error is vectorial in both planes.

In the event that the bobbin is slipped on only partially due to incorrect functioning or if the last bobbin is drawn back again because of tangling of the thread, e.g. with the fork G, as shown in FIG. 11, the bobbin arm can not be moved into the position designated by 4' in FIG. 2, but rather is stopped by a slight bending of the positioning head 6a when the electrical contacts 6g are reactivated.

In the normal case, the tube arm 8 is then swiveled into the corresponding aligning position relative to the winding spindle just emptied and the empty tubes 5 are slipped on the empty winding spindle via the push out mechanism.

FIGS. 13 and 14 show a preferred embodiment variant of the positioning head 6a. The positioning head 6a is connected with the bobbin spindle 6 by means of a bending rod 6c and holder 6b.

The four electrical contacts 6g, each of which comprises a wire shoe 6e, are fastened at the holder 6b by leaf springs 6d so as to be electrically insulated.

These four electrical contacts are located opposite a contact ring 6f in the positioning head 6a with a slight gap S.

The vectorial bending of the positioning head 6a on the bending rod 6c which is caused by alignment errors $\pm P_v$ and $\pm P_h$ causes the contact ring 6f to make contact with one or two of the electrical contacts 6g and causes the readjustment of the apparatus 1 in order to compensate for vertical and/or horizontal position errors.

It is noted here that the entire apparatus can also be designed as a tandem apparatus 1AB for synchronous handling of two adjacent bobbin spinning head pairs. This is also indicated in FIG. 8.

Naturally, the described embodiment example of the invention can be modified in various respects without departing from the basic concept. Thus, other constructional elements can be made use of instead of the handling elements indicated here, such as linear drives, clamping jaws for the inner and outer clamping of elements, clamping sleeves for gripping the free ends of the bobbin tubes, and the like. For example, the inner centering of the paper tubes can be effected by means of inflatable pneumatic elements, the control can be effected via contactless or contacting end switches, etc.

It is also substantial for the invention that the paper tubes and/or the bobbins can be slipped on and off closely adjacent to one another. Of course, this can also be effected when the latter are at a distance from one another, elements can be held back via corresponding brakes, and the like.

I claim:

1. An apparatus for at least partially automatic handling of empty bobbin tubes and completely wound bobbins of a spinning machine, said apparatus comprising:

a common apparatus frame;

a take-over/transfer arm for empty tubes supported on said common frame;

a take-over/transfer arm for wound bobbins, supported on said common frame;

an actuating and swivel mechanism supported on said common frame for swivelling said empty tube take-over/transfer arm and said wound bobbin take-over/transfer arm between a service position of said empty tube take-over/transfer arm and said wound bobbin take-over/transfer arm, in which wound bobbins are slipped onto said wound bobbin take-over/transfer arm and empty tubes are slipped off said empty tube take-over/transfer arm, a transporting position in which the wound bobbin take-over/transfer arm and the empty tube take-over/-transfer arm are displaced between a wound bobbin unloading and empty tube loading station and a spinning machine, and wound bobbin unloading and empty tube loading position, in which the wound bobbin is slipped off said wound bobbin take-over/transfer arm and the empty tubes are slipped onto said empty tube take-over/transfer arm;

wherein said actuating and swivel mechanism includes swivel means for swivelling said take-over/-transfer arms within a space defined by said common frame, about three spatial axes, defining respectively, the service, transporting and wound tube unloading and empty tube loading positions of said take-over/transfer arms.

2. The apparatus of claim 1, wherein said swivel means comprises drive means for synchronously driving said take-over/transfer arms at least within certain predetermined ranges.

3. The apparatus of claim 1, wherein each of said take-over/transfer arms has at a free end thereof a positioning head for compensating a misalignment between a respective take-over arm and a winding spindle.

4. The apparatus of claim 1, further comprising a torque rod suspension for supporting said take-over/-transfer arms and said actuating and swivel mechanism on said common frame.

5. The apparatus of claim 4, further comprising a swivelling mechanism for supporting said torque rod suspension on said common frame.

6. The apparatus of claim 1, wherein said take-over/-transfer arm for empty tubes and said take-over/transfer arm for wound bobbins each includes a means for slipping off and on an empty tube and a wound bobbin, respectively.

7. The apparatus of claim 6, wherein said take-over/-transfer arm for empty tubes and said take-over/transfer arm for wound bobbins each includes a taking over and transferring means for positioning the empty tube and the wound bobbin, respectively, in at least one of an adjacent relationship and a spaced relationship; and wherein each of said take-over/transfer arm for empty tubes and said take-over/transfer arm for wound bobbins includes a retaining brake for a tube and a bobbin, respectively, whereby the tube and the bobbin cannot be slipped off.

8. The apparatus of claim 6, wherein said slipping off and on means includes linear drive means for effecting slip off and on movement of the empty tube and the wound bobbin.

9. The apparatus of claim 1, wherein said frame includes an undercarriage and an all-wheel steering means for driving said undercarriage.

10. The apparatus of claim 1, wherein said actuating and swivel mechanism includes at least one of hysteresis coupling means, magnetic coupling means, and magnetic brake means.

11. The apparatus of claim 1, wherein each of said take-over/transfer arms includes cam means for centering an empty tube and a wound bobbin, respectively, on a respective take-over/transfer arm.

* * * * *